United States Patent [19]

Cappel et al.

[11] 4,168,154

[45] Sep. 18, 1979

[54] SINTERING PROCESS FOR IRON ORE MIXTURES

[75] Inventors: Fred Cappel, Dreieich; Walter Hastik, Frankfurt am Main, both of Fed. Rep. of Germany

[73] Assignee: Dravo Corporation, Pittsburgh, Pa.

[21] Appl. No.: 884,352

[22] Filed: Mar. 7, 1978

[30] Foreign Application Priority Data

Mar. 7, 1977 [DE] Fed. Rep. of Germany ..... 2709769

[51] Int. Cl.[2] ..... C22B 1/20

[52] U.S. Cl. ..... 75/5

[58] Field of Search ..... 75/3, 4, 5, 33, 34, 75/35, 36

[56] References Cited

U.S. PATENT DOCUMENTS

| | | | |
|---|---|---|---|
| 2,750,273 | 6/1956 | Lellep | 75/3 |
| 3,020,147 | 2/1962 | Boss et al. | 75/5 |
| 3,489,550 | 1/1970 | Anderson | 75/5 |
| 3,963,481 | 6/1976 | Powers | 75/5 |
| 4,065,295 | 12/1977 | Cappel et al. | 75/5 |

FOREIGN PATENT DOCUMENTS

| | | | |
|---|---|---|---|
| 298674 | 3/1971 | U.S.S.R. | 75/5 |

*Primary Examiner*—L. Dewayne Rutledge
*Assistant Examiner*—Michael L. Lewis
*Attorney, Agent, or Firm*—Parmelee, Miller, Welsh & Kratz

[57] ABSTRACT

A process for sintering iron ore mixtures containing solid fuels on sintering strands in which uniform sinter is obtained throughout the depth of the charge by igniting the surface of the charge and subsequently treating it with hot gases under a set of defined conditions.

7 Claims, 3 Drawing Figures

A. EMPIRICAL FUEL REQUIREMENT FOR OPTIMUM IGNITION

B. EMPIRICAL RATE FOR OPTIMUM IGNITION

C. EMPIRICALLY DETERMINED RATE FOR 100 % SUPPLY AT 800° C GAS TEMPERATURE

A. EMPIRICAL FUEL REQUIREMENT FOR OPTIMUM IGNITION

B. EMPIRICAL RATE FOR OPTIMUM IGNITION

C. EMPIRICALLY DETERMINED RATE FOR 100 % SUPPLY AT 800° C GAS TEMPERATURE

HEAT TREATMENT TIME IN % WITH THE GIVEN GAS TEMPERATURE WITH SUBSEQUENT SUPPLY WITH 275° C GAS TEMPERATURE UP TO 100 %

SINTERING PROCESS FOR IRON ORE MIXTURES

The present invention relates to a process for sintering iron ore so that the sinter which is produced is uniform in its physical and chemical properties.

Because much of the iron ore which remains in some of the world's principal iron ore deposits is too fine to serve as a desirable blast furnace feed, it is necessary that it be agglomerated into larger, more useful particles. An important means of effecting such agglomeration is sintering. In the sintering process, the fine ore is heated to such a temperature that, while complete fusion does not occur, the small solid particles in contact with one another adhere and agglomerate into larger particles. While this process is simple in principle, a difficulty has heretofore existed in that the finished sinter often lacks uniformity in its physical and chemical properties and is, therefore, less effective as blast furnace fed than uniform sinter.

It is the object of the present invention to provide a process whereby such optimum uniformity in the finished sinter can be attained.

The invention is illustrated in the accompanying figures, in which.

Figure 1:
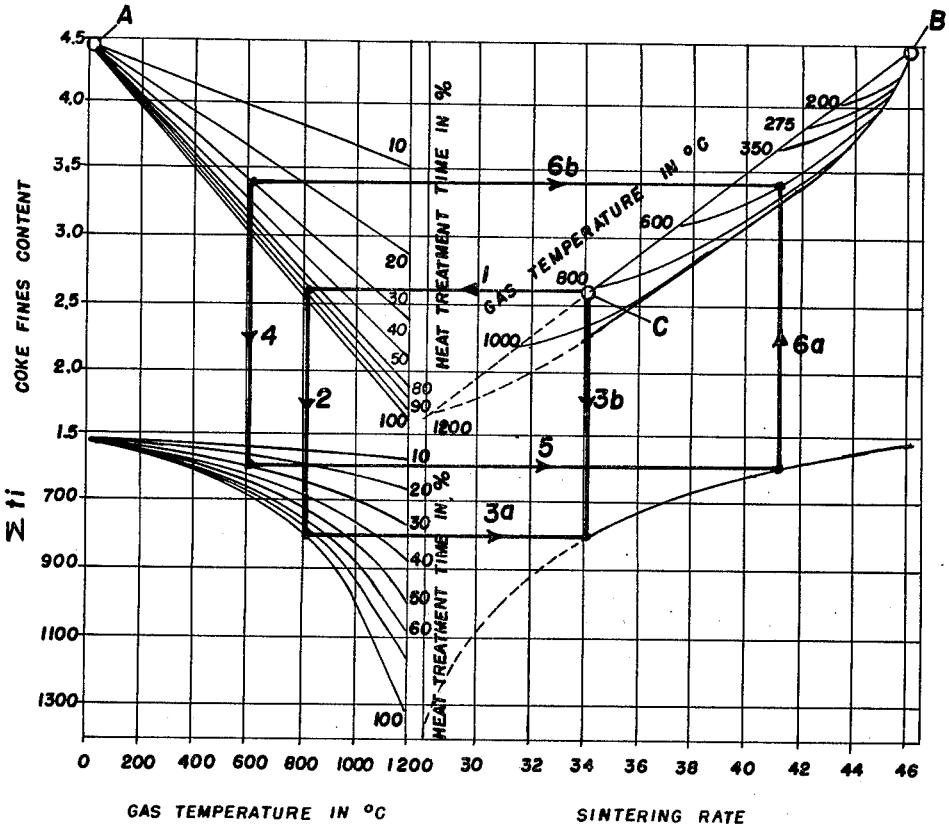
FIG. 1 is a set of curves showing the coke fine content of a charge with respect to gas temperature and sintering rate and a variable, hereinafter more fully explained, known as the sum of retained sintering times with respect to gas temperature and sintering rates.

While sintering is sometimes carried out in rotary kilns or by batch processing on sinter pans or hearths, the most common means of effecting the process is on a moving continuous belt or grate. The ore is mixed with a solid fuel such as coke fine and, near the head or feed end of the strand, the surface of the charge is ignited. The mixture is carried by the strand across a plurality of wind boxes which causes the combustion front to move progressively downward so that, ideally, the sintering temperature of the mixture will be reached throughout the entire depth of the charge before the mixture is removed from the strand at the discharge point. In practice, however, it is often found that not only do the characteristics of the sinter vary substantially at different points along the depth of the charge, but that at the base of the charge the required temperature had never been reached, so that satisfactory sintering temperature had not even occurred.

It is known in the art that, during the sintering process, part of the solid fuel can be replaced by treating the charge with hot gases following ignition. Returned process gases from the sintering operation or other suitable gases are mixed with oxygen and are applied to the charge from a burner hood which overhangs part of the sintering strand. The length of the hood generally in use is about one-third of the length of the sintering strand, and the gas temperature, depending on the sinter mixture used, is between 700° C. and 1200° C. Previous efforts to ensure uniformity of the sinter by finding an optimum combination of hood length and gas temperature, while at the same time maintaining the thermal efficiency of the operation, have been generally unsuccessful. Reduced hood length was not desirable since the coke fine content had to be increased substantially. A noticeable decrease in efficiency was observed with a longer hood. The selection of too high a gas temperature entailed the danger of excessive slagging of the charge surface.

By virtue of the present invention, however, conditions relating to the ignition of the charge and subsequent addition of hot gases have been established and defined so that optimum conditions throughout the depth of the charge can be maintained.

According to this invention, optimum results for a more or less conventional sintering apparatus will be achieved if ignition of the charge is effected with hot gases of between 1100° C. and 1300° C. over a length of 6.5 to 13 percent of the length of the sintering strand located over wind boxes, with the condition that the length of ignition and the temperature of the hot gases are so adjusted that, if the charge is divided into horizontal partial layers, the sintering temperature of the charge will, during sintering, be reached in as many partial layers as possible. In a preferred embodiment of this invention, the ignition of the charge takes place over a length of 7.8% to 10.4% of the sintering strand.

The calculation of the temperature progress within the charge during the sintering process was executed on the basis of the following pattern.

The charge was considered to have been divided into partial layers of finite dimensions, and the sintering process was divided into successive partial periods. The temperature of each of the partial layers and partial periods was then calculated, step by step, with the following assumptions:

(1) The transmission of heat takes place by convection.

(2) There were heat equivalent gas and material quantities present.

(3) The exchange of heat within a partial period between gas and sinter mixture is complete, between air and sinter it takes place with a heat exchange factor of 0.2.

(4) Heat losses were disregarded.

(5) The consumption of heat through water evaporation, the removal of hydrate water and $CO_2$, as well as the formation of CO and FeO, was considered. Water evaporation was considered to take place as long as hot gas flows into a charge which is still damp. The heat for the loss on ignition, as well as for the formation of CO and FeO, was directly subtracted from the fuel heat.

(6) The combustion of the carbon in the charge was considered to take place during partial period 1 with partial gas rate 1, during partial period 2 in partial layer 2 with partial gas rate 2, and so on with respect to each partial layer and partial period.

(7) It was considered that the sintering temperature of the charge could not be exceeded. The excess heat generated during combustion of the carbon was considered to have been stored within the respective partial layers and is used to heat the colder air flowing in during subsequent partial periods until it is consumed.

(8) The number of partial periods was selected so that the temperature in each partial layer corresponded to the actual measured temperature rise.

The following factors were used as input:

(1) the moisture content of the charge;

(2) the heat loss on ignition and the carbon content of the charge;

(3) the heat of formation of the CO and FeO;

(4) the gas inlet temperature at various partial periods; and (5) the sintering temperature of the charge.

From the exothermic and endothermic heat determined to be present, there resulted the heat available for temperature increase and possibly for sintering. It is noted that empirical data was taken from a test where sintering was complete, that is, the amount of material recovered from the process was equal to the amount of input.

On the basis of the foregoing assumptions and data, the following calculations were made:

(1) the sintering heat available within the individual partial layers (hereafter $S_i$);

(2) the length of time that individual partial layers remain at the sintering temperature (hereafter $t_i$); and (3) the number of partial layers in which the sintering temperature was not reached.

An example of a portion of such calculations, in which the temperature progress during the sintering process was determined, is included below:

EXAMPLE

Exchange of heat in partial layer 1 at partial period 1 with partial volume of gas 1:

| | |
|---|---|
| 728 | gas inlet temperature in °C. (of the ignition) |
| + 10 | temperature of mixture prior to heat exchange in °C. |
| + 580.14 | heat available to increase temperature and for sintering, stated as heat-equivalent temperature |
| − 192 | heat required to evaporate the water, stated equivalent temperature |
| 1126.14 | °C. for solids and gas, i.e., gas and solids are heated to half of the temperature, i.e., to |
| 563 | °C. |

Exchange of heat in partial layer 2 at partial period 1 with partial volume of gas 1:

| | |
|---|---|
| 563.07 | gas temperature in °C., see above |
| + 10 | temperature of mixture in °C. |
| − 192 | heat required to evaporate the water, stated as equivalent temperature |
| 381.07 | °C. for solids and gas, i.e., gas and solids are heated to half the temperature, i.e., to |
| 190.54 | °C. |

Exchange of heat in partial layer 1 at partial period 2 with partial volume of gas 2:

| | |
|---|---|
| 1058 | gas inlet temperature in °C. (of the ignition) |
| + 563.07 | temperature of mixture in °C., see above |
| 1621.07 | °C. for solids and gas, i.e., gas and solids are heated to half the temperature, i.e., to |

-continued

| | |
|---|---|
| 810.54 | °C. |

This sample calculation is reproduced in part. At partial period 1, the partial gas volume 1 exchanges its heat in partial layer 1. For the ignition, a temperature profile was assumed in which the gas inlet temperature at partial period 1 was 728° C. Heat equivalent gas and materials of 580.14° C. were also available to increase the temperature and for sintering. For this particular case, the heat required for evaporation is equivalent in temperature to 192° C., which must be subtracted because hot gas enters a damp mixture. The calculation is then continued with partial gas volume 1 at partial period 1 in partial layer 2. Fuel does not yet burn here, since the fuel of partial layer 2 does not burn until partial period 2 with partial gas volume 2. Water, however, does evaporate since, once again, hot gas comes into contact with a damp mixture. The example also demonstrates how the calculation starts in the second partial period with the second partial gas volume in partial layer 1. For the gas inlet temperature, that temperature is again inserted which corresponds to the increased temperature profile in the ignition hood at this point. The mixture is of a temperature which is present in partial period 1 after the heat exchange of the partial layer 1 with partial gas volume 1.

The sintering temperature of the mixture was 1340° C. In the subject case, it was reached for the first time at the ninth partial period in the ninth partial layer, the total being divided into 70 partial layers. In this example, seven partial periods were selected for the ignition, followed by the admission of hot gases of 1200° C. over 18 partial periods.

It was determined that, for equal slagging of the sinter, the product of the sum of the sintering heats and the duration of the sintering must be constant in all the partial layers. Under such conditions, it was possible to determine the required fuel content for other gas inlet temperatures and also for modified effective periods. At the same time, the number of partial layers which did not reach the sintering temperature was determined. In this way, it was determined under what conditions the least number of partial periods would exist in which the sintering temperature had not been achieved. As has been noted, it was determined that, when the ignition of the charge takes place over a length of 7.8% to 10.4%, excellent ignition with respect to the goal of establishing optimum sintering conditions is achieved.

After having thus established the optimum conditions for ignition, it was determined that it would be desirable to apply hot gases to the charge subsequent to ignition. As will be hereinafter more fully explained, it was calculated that the most satisfactory results could be obtained when these gases were applied over a length of 14% to 20% of the sintering strand with a preferred embodiment existing in the 16% to 18% zone.

The calculation of operational conditions for the admission of hot gases following ignition was executed by means of the following calculations.

Starting with the optimum ignition determined according to the above-described calculations, the calculations are continued for the admission of hot gases of varying temperatures from termination of ignition, over wind boxes, to the end of the sintering strand. The values were calculated for the same constant product of the sum of the heats of fusion ($S=\Sigma S_i$) available in the individual partial layers and the retention times of melting temperature ($t=\Sigma t_i$) in the individual partial layers.

Figure 2:
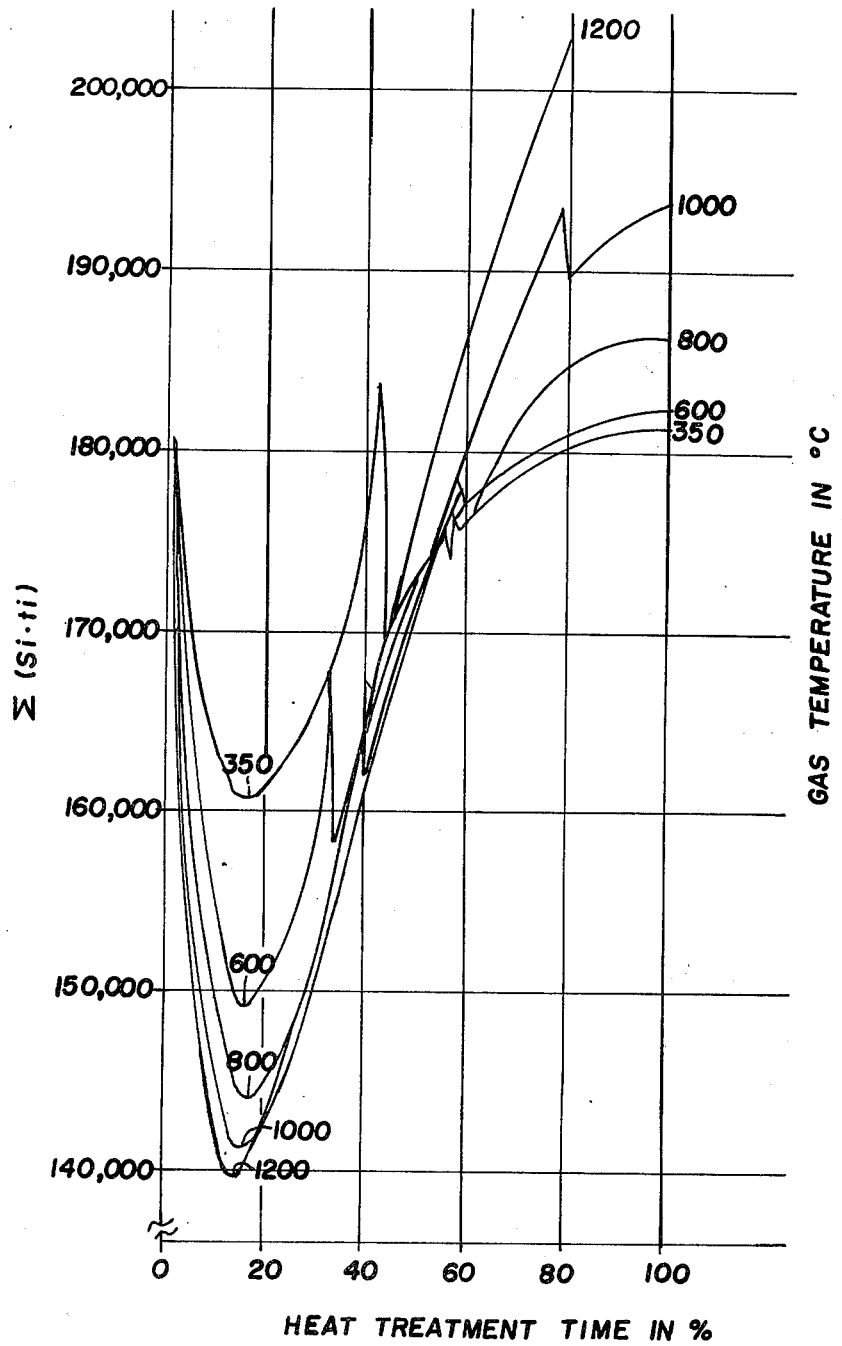
FIG. 2 is a set of curves showing a variable, hereinafter more fully explained, known as the sum of the products of layer sintering heats and retained sintering times with respect to length of heat treatment for certain temperatures of hot gas.

The values calculated were then used to derive the curves on the left-hand side of FIG. 2. It is noted that from the curve on the upper left, the solid fuel requirements for various conditions (both temperature and treatment time) for the admission of hot gases after ignition can be obtained.

It is established by the present invention that the rate at which sintering can be conducted depends exclusively on t, as is shown by the curve in the lower right-hand section of FIG. 1. That curve was derived from two empirical values. One is the sintering rate for optimum ignition (point B in FIG. 1). The other is an empirically determined rate which results in complete sintering of the charge when the sintering strand is treated with hot gases of 800° C. for 100% of its length.

Once these two performance values were established, it was possible, with the help of the left-hand side of FIG. 1, to calculate the other performance values since the sintering rate at 100% admission of hot gases, as is taught by this invention, is proportionate to gas temperature (see arrows 1, 2, 3*a*, 3*b*). Since the sintering rate, even for a shorter effective period, depends exclusively on t, the other performance data were determined by reference to the left-hand and lower right section (see arrows 4, 5, 6*a*, 6*b*). From the overall picture, any interrelation between different values are determined.

Further it was observed that the sintering process developed most uniformly throughout the depth of the charge if the sum of the individual products, $\Sigma(S_i \cdot t_i)$, is as low a figure as is possible. In order to determine where the conditions would be such so that such uniformity could be obtained, $\Sigma(S_i \cdot t_i)$ was, for various temperatures of hot gases, plotted against the percentage of the length of the sintering strand above the wind boxes. This plot is shown in FIG. 2. As can be seen from this curve, good results were predicted within the 14% to 20% range. It was further apparent that a preferred embodiment existed where the sintering strand, subsequent to ignition, would be treated with hot gases of 1100° C. to 1300° C. over 16% to 18% of its length.

Another advantage derived from the present invention is that uniform sintering characteristics can be obtained by treating the charge, subsequent to ignition, with hot gases of 600° to 1200° C. over 14% to 20% of the length of the charge and thereafter using warm gases of 150° to 400° C.

Figure 3:
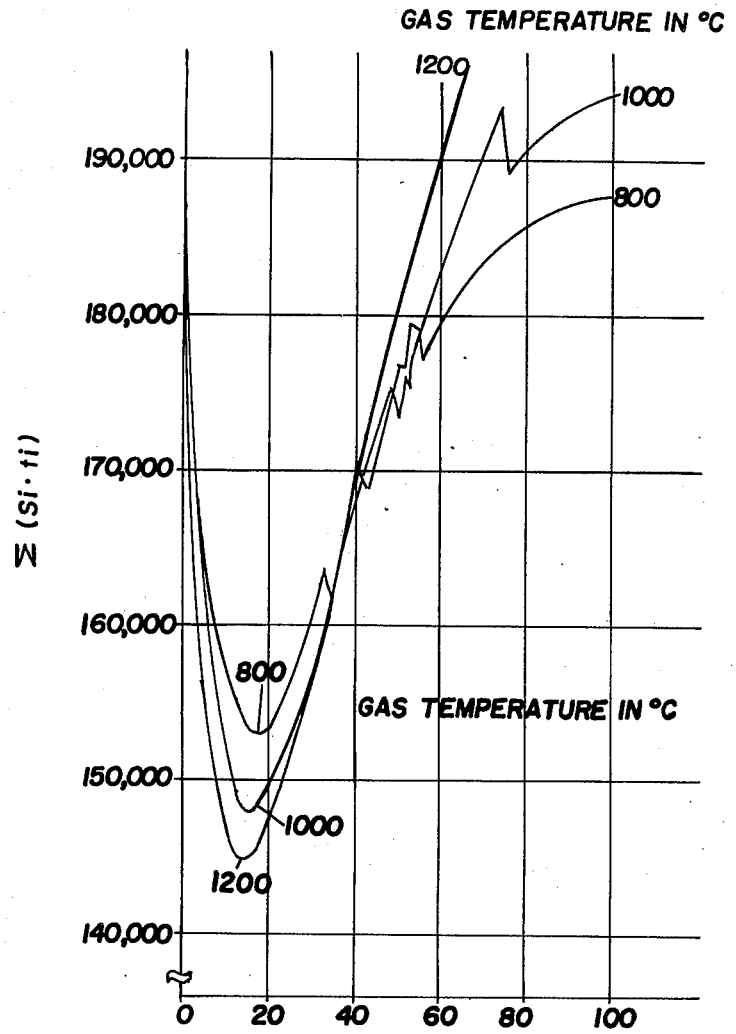
FIG. 3 is a set of curves showing the sum of the products of layer sintering heats and retained sintering times with respect to length of heat treatment for certain temperatures of hot gas under conditions where the sinter strand is subjected to warm gas of 275° C. from the point where the hot gas terminates until the discharge point.

In FIG. 3, the effect of first treating the charge with hot gases and then with 275° C. warm gases is shown. These curves indicate that here, too, optimum uniformity occurred when hot gases were applied over 16% to 18% of the length. Under such conditions, sinter which was only slightly less uniform than that obtained under FIG. 2 optimum conditions was obtained.

It will thus be seen that the objects set forth above are efficiently attained.

We claim:

1. In a process for sintering on sintering strands, iron ore mixtures containing solid fuels wherein the fuel near the surface of the charge is ignited by means of hot gases, said hot gases being passed through the charge, and wherein sintering of the charge is subsequently maintained by means of a gaseous mixture containing oxygen which is passed through the charge, the improvement which comprises: using hot gases of a temperature of 1100° to 1130° C. over a length of 6.5% to 13% of the sintering strand over wind boxes to ignite the charge.

2. A process according to claim 1 wherein the hot gases used to ignite the charge are applied over a length of 7.8% to 10.4% of the length of the sintering strand located over wind boxes.

3. A process according to claim 2 wherein the gaseous mixture containing oxygen which is used to maintain sintering subsequent to ignition is comprised of hot gases.

4. A process according to claim 3 wherein the gaseous mixture containing oxygen which is used to maintain sintering subsequent to ignition is applied over a length of 14% to 18% of the length of the sintering strand located over wind boxes.

5. A process according to claim 3 wherein the gaseous mixture containing oxygen which is used to maintain sintering subsequent to ignition is applied over a length of 16% to 18% of the length of the sintering strand located over wind boxes.

6. A process according to claim 3 wherein the gaseous mixture containing oxygen which is used to maintain sintering subsequent to ignition is initially applied at a temperature of 600° C. to 1100° C. over a length of 14% to 20% of the length of the sintering strand located over wind boxes and is thereafter applied at a temperature of 150° C. to 400° C. over a further length of the sintering strand.

7. A process according to claim 6 wherein the gaseous mixture containing oxygen which is used to maintain sintering subsequent to ignition is initially applied at a temperature of 600° C. to 1200° C. over a length of 14% to 10% of the length of the sintering strand located over wind boxes and is thereafter applied at a temperature of 150° C. to 400° C. over a further length of the sintering strand.

* * * * *